US012110640B2

(12) United States Patent
Meier

(10) Patent No.: US 12,110,640 B2
(45) **Date of Patent: *Oct. 8, 2024**

(54) SOIL WORKING ROLLER FOR A SOIL PROCESSING MACHINE

(71) Applicant: Hamm AG, Tirschenreuth (DE)

(72) Inventor: Matthias Meier, Tirschenreuth (DE)

(73) Assignee: HAMM AG, Tirschenreuth (DE)

( * ) Notice: Subject to any disclaimer, the term of this patent is extended or adjusted under 35 U.S.C. 154(b) by 515 days.

This patent is subject to a terminal disclaimer.

(21) Appl. No.: 17/383,863

(22) Filed: Jul. 23, 2021

(65) Prior Publication Data

US 2022/0034045 A1 Feb. 3, 2022

(30) Foreign Application Priority Data

Aug. 3, 2020 (DE) ..... 10 2020 120 376.4

(51) Int. Cl.
*E01C 19/23* (2006.01)
*E01C 19/26* (2006.01)
(Continued)

(52) U.S. Cl.
CPC ..... *E01C 19/236* (2013.01); *E01C 19/26* (2013.01); *E01C 21/00* (2013.01); *E02D 3/0265* (2013.01)

(58) Field of Classification Search
CPC ..... E01C 19/236; E01C 19/26; E01C 21/00; E02D 3/0265
(Continued)

(56) References Cited

U.S. PATENT DOCUMENTS 1,560,295 A * 11/1925 Keeler ..... E01C 19/43 404/124
1,623,142 A * 4/1927 Walsh ..... E01C 19/236 404/124
(Continued)

FOREIGN PATENT DOCUMENTS

CN 202440746 U 9/2012
DE 102013208261 11/2014
(Continued)

OTHER PUBLICATIONS

German Search Report for German application No. 10 2020 120 376.4 dated Apr. 27, 2021, 14 pages .

*Primary Examiner* — Raymond W Addie
(74) *Attorney, Agent, or Firm* — RANKIN, HILL & CLARK LLP

(57) ABSTRACT

A soil working roller for a soil processing machine comprises a roller body (22), rotatable about a roller axis of rotation (W), with a support structure (28) for rotatable mounting of the roller body (22) and with a support sheath (34) supported radially outward on the support structure (22), further comprising a working sheath (38), which contacts a support sheath outer side (36) and provides a working exterior (46) of the soil working roller (20) and comprises a plurality of working sheath segments (40), following one another in the circumferential direction, wherein each working sheath segment (40) has a segment shell (42) and a plurality of radially inwardly projecting fastening means (76) are fixedly arranged on each segment shell (42) facing the support sheath outer side (36) of the support sheath (34) and/or on the segment shell inner side supporting the support sheath outer side (36), and wherein a fastening means through opening (78) is provided in the support sheath (34) in association with each fastening means (76), and each fastening means (76) engaging through a
(Continued)

Figure 1:
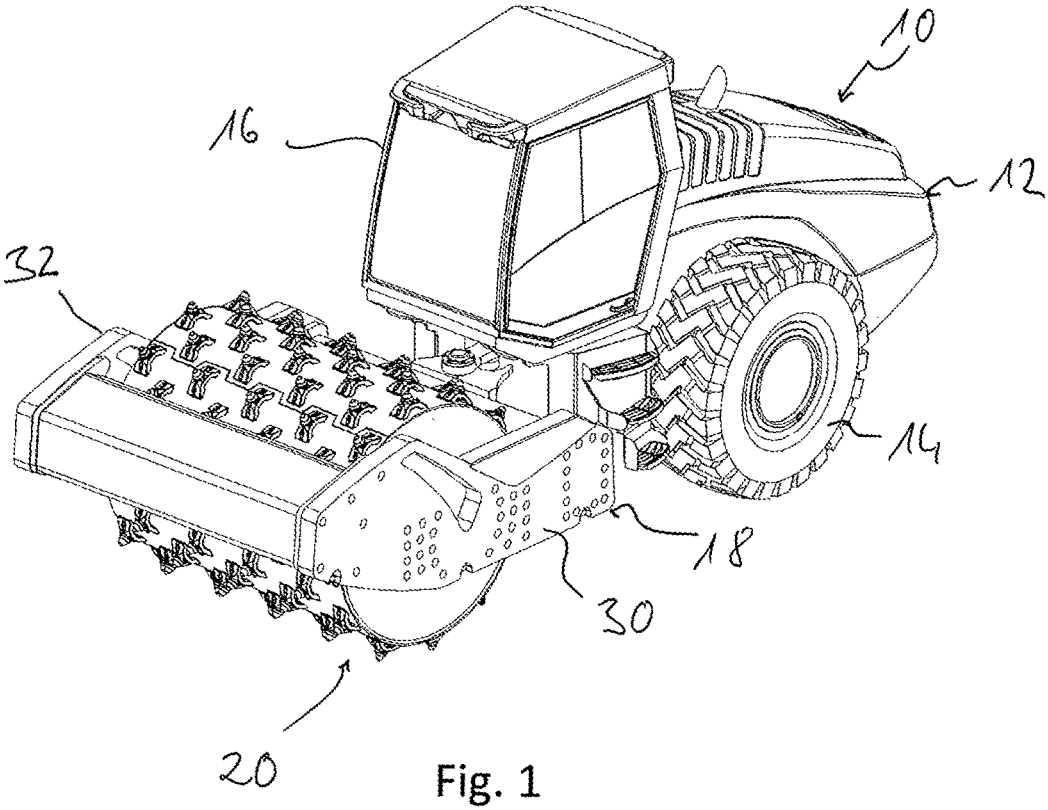

fastening means through opening (78) projects on a support sheath inner side of the support sheath (34) for fastening to or with respect to the roller body (22).

27 Claims, 11 Drawing Sheets

(51) Int. Cl.
*E01C 21/00* (2006.01)
*E02D 3/026* (2006.01)

(58) Field of Classification Search
USPC ..... 404/117, 121, 124, 127
See application file for complete search history.

(56) References Cited

U.S. PATENT DOCUMENTS 1,744,272 A * 1/1930 La Plant ..... E01C 19/24 404/124
4,632,599 A * 12/1986 Sadahiro ..... E01C 19/236 404/124
5,421,670 A * 6/1995 Meirick ..... E01C 19/43 404/124
5,511,901 A * 4/1996 Yates ..... E01C 19/236 404/124
6,095,717 A 8/2000 Kaldenberg et al.
6,390,204 B1 * 5/2002 Schafle ..... E02D 3/026 172/554
6,554,532 B1 * 4/2003 Motz ..... E02D 3/046 404/124
8,007,200 B2 * 8/2011 Brockway ..... E02D 3/039 404/124
8,333,439 B2 12/2012 Gibbins
10,030,341 B1 * 7/2018 Burger ..... E01C 19/23
2002/0114667 A1 * 8/2002 Kaldenberg ..... E02D 3/026 404/124
2005/0225162 A1 10/2005 Gibbins
2007/0086861 A1 * 4/2007 Pratt ..... E01C 19/43 404/124
2007/0280783 A1 * 12/2007 Gibbins ..... E02D 3/026 404/124
2011/0251036 A1 10/2011 Doetsch et al.
2018/0202114 A1 7/2018 Burger

FOREIGN PATENT DOCUMENTS

EP 3498919 6/2019
GB 1211568 * 3/1967 ..... E01C 19/236
JP 60-027106 2/1985
JP 8-209617 8/1996
JP 2016-121473 7/2016
JP 2018-112056 7/2018
JP 2019-116821 7/2019
WO 2006056767 6/2006

* cited by examiner

SOIL WORKING ROLLER FOR A SOIL PROCESSING MACHINE

The present invention relates to a soil working roller for a soil processing machine.

Soil processing machines constructed with soil working rollers are used to process substrates in different areas. These types of soil processing machines are thus used as soil compactors, for example in road construction, in order to compact asphalt materials or the substrate underneath the asphalt material, wherein the compactor rollers provided for the soil processing machines functioning as soil compactors have an unstructured, thus substantially smooth and closed working exterior to obtain the smoothest surface of the compacted material. Roller tools, for example, padfoot tools or chisels, may be provided on the soil working rollers to provide structured working exteriors for other operations.

A soil processing machine is known from DE 34 27 675 A1, whose compactor roller supports roller tools formed on a roller shell in the shape of padfoot tools such that the soil working roller is basically designed with a structured working exterior. In order to be able to also use the soil working roller of this known soil processing machine in applications which require a smooth, unstructured working exterior, multiple sheath segments following one another in the circumferential direction may be fastened on the roller shell by screwing. When the sheath segments are fastened on the soil working roller, these form a smooth, thus substantially unstructured working exterior surrounding the soil working roller with the padfoot tools provided on its roller shell. Depending on whether the compactor rollers of this known soil processing machine are surrounded by sheath segments or not, the working exterior is provided either by the respective roller shell of the soil working roller rotatably supported on a frame, or by the sheath segments surrounding the roller shell.

It is the object of the present invention to provide a soil working roller for a soil processing machine which is easily adaptable to different operations.

This problem is solved according to the invention by a soil working roller for a soil processing machine comprising a roller body, rotatable about a roller axis of rotation, with a support structure for rotatable mounting of the roller body and with a support sheath supported radially outward on the support structure, further comprising a working sheath, which contacts a support sheath outer side and provides a working exterior of the soil working roller and comprises a plurality of working sheath segments following one another in the circumferential direction, wherein each working sheath segment has a segment shell and a plurality of radially inwardly projecting fastening means are fixedly arranged on each segment shell facing the support sheath outer sides of the support sheath and/or supported on the support sheath outer side, and wherein a fastening means through opening is provided in the support sheath in association with each fastening means, and each fastening means engaging through a fastening means through opening projects on a support sheath inner side of the support sheath for fastening to or with respect to the roller body.

The soil working roller designed according to the invention basically differs from the soil working rollers known from the prior art in that the sheath, rotatably supported on a support structure about the roller axis of rotation, is not a roller shell providing a working exterior, but instead a support sheath on which the working sheath, which provides a working exterior for an operation to be carried out, is fastened or fastenable as a separate component.

This means that, in the case of a soil working roller designed according to the invention, the support sheath does not provide the working exterior for processing a substrate in any operating state, and that the working exterior for processing a substrate in each operating state is provided by the working sheath, or on the working sheath, to be fastened on the roller body as a separate component.

This has the result that the support sheath may be provided with structures which facilitate a defined and stable fastening of the working sheath constructed using multiple working sheath segments, without requiring consideration that these types of structures, if they were provided on a working exterior of a soil working roller, might impair the processing result on the one hand and might be subjected to wear impairing their functionality on the other hand.

In order to be able to prevent a degradation of an operation due to structures, which might be reproduced in the ground to be processed, for example, asphalt material, it is proposed that no openings penetrating the segment shells are provided on the segment shells in the area of the fastening means. This means that the segment shells are also closed in particular in those areas in which fastening means are provided on the same, and thus provide a continuous, uninterrupted outer surface.

For a stable fastening of the working sheath segments to the roller body, it is further proposed that at least one fastening means is fixedly arranged on the segment shells in at least three connecting regions respectively located spaced apart from one another in the direction of the roller axis of rotation.

For this purpose, for example, at least two fastening means, arranged with circumferential spacing apart from one another, may be fixedly arranged in end connecting regions located on axial end areas of a respective segment shell.

In particular, in order to thereby be able to achieve a fastening of the segment shells in edge areas located in the circumferential direction, it is further proposed that a circumferential spacing of the fastening means to one another is greater in the end connecting regions than a circumferential spacing of a respective fastening means to a segment shell longitudinal edge directly adjacent to the same.

Furthermore, a fastening means may be fixedly arranged, for example, in a circumferential center area of the segment shell for a stable fastening of the working sheath segments to the roller body in at least one center connecting region located between the axial end areas of a respective segment shell. Reference is made to the fact that a center connecting region of this type does not necessarily have to be positioned exactly in an axial longitudinal center of a respective segment shell.

To fasten the working sheath segments to the roller body, a fastening area may be fixedly arranged in association with at least one, preferably each fastening means on the support sheath inner side of the support sheath.

In order to thereby easily facilitate a fastening interaction between a fastening area and a fastening means provided on a segment shell, it is proposed that each fastening area on the support sheath is fixedly arranged axially following a fastening means through opening. This has the result that a fastening means engaging through a fastening means through opening may be positioned directly adjacent to an assigned fastening area and thus fastened to the same.

For a simply and stably configured structure, at least one fastening area, provided in association with a fastening means arranged in a center connecting region, may be provided on the support structure.

For example, the support structure may comprise for this purpose at least one support disk connected to the support sheath inner side of the support sheath, and at least one, preferably each fastening area, provided in association with a fastening means fixedly arranged in a center connecting region, may be provided in a radially outer area of a support disk.

Alternatively or additionally, at least one fastening area may comprise a fastening projection projecting radially inward on the support sheath inner side of the support sheath to provide one or more fastening areas through the support structure.

For an easily producible, stable, and also easily detachable connection, a fastening means may be fastenable by a screw connection to at least one, preferably each fastening area.

A stable connection of the working sheath segments to the roller body may be further supported in that at least one of the fastening means is designed as plate-like and is arranged extending in the circumferential direction.

For example, at least one circumferentially-extending, plate-like fastening means may be provided in at least one center connecting region.

Alternatively or additionally, at least one circumferentially-extending, plate-like fastening means may be provided in at least one end connecting region.

In another embodiment, at least one fastening means, preferably a plurality of fastening means, may be designed as bolt-like and be arranged extending substantially radially.

A stable connection to the support sheath may thereby be achieved, for example, in that at least one substantially radially-extending, bolt-like fastening means is designed with external threads. The fastening may be carried out with respect to the support sheath by nuts screwed onto this type of external threads.

In another embodiment, at least one, preferably each substantially radially-extending, bolt-like fastening means may have a bolt head located at a distance from the segment shell and interacting with a jaw assembly for fastening the segment shell to the support sheath.

This type of jaw assembly may thereby comprise two clamping jaws, fixed to one another, opposite one another, and surrounding the bolt head of at least one substantially radially-extending, bolt-like fastening means.

To guarantee a stable fixing on the roller body without play, it is further proposed that the clamping jaws of a jaw assembly, surrounding at least one bolt head of a substantially radially-extending, bolt-like fastening means, are supported on the support sheath inner side of the support sheath and generate a force effect acting radially inwardly on the at least one bolt head surrounded by the same.

If at least one jaw assembly interacts with the bolt heads of two substantially radially-extending, bolt-like fastening means, arranged on the segment shells of working sheath segments directly adjacent to one another in the circumferential direction, then it is guaranteed that the working sheath segments may be fastened on the support sheath close to their edge areas located in the circumferential direction.

For example, at least one substantially radially-extending, bolt-like fastening means may be fixedly arranged in at least one end connecting region.

At least one, preferably each fastening means through opening may be provided as slot-like and/or elongated substantially in the circumferential direction to interact with the fastening means.

For a stable connection of fastening means designed as bolt-like, these may have a radially expanded bolt foot fastened to the support sheath, e.g., by welding. In order to be able to accommodate fastening means shaped in this way into fastening means through openings assigned to the same, it is further proposed that at least one fastening means through opening, engaged through by a substantially radially-extending, bolt-like fastening means, is expanded in a longitudinal area transverse to its longitudinal extension to accommodate a bolt foot of the substantially radially-extending, bolt-like fastening means engaging through this fastening means through opening. When mounting circularly curved working sheath segments structured with these types of fastening means on the support sheath, the bolt-like fastening means with their bolt heads may be guided through the sections of the through openings connecting to the expanded longitudinal areas until the bolt feet enter into the respectively expanded longitudinal area.

In an alternative embodiment for fastening multiple or all working sheath segments following one another in the circumferential direction on the roller body, fastening means, engaging through a fastening means through opening, of at least two, preferably all working sheath segments directly following one another in the circumferential direction, may be pretensioned on one another in the circumferential direction by a circumferential clamping means arranged radially inside of the support sheath.

The working sheath may thereby comprise, for example, at least four, preferably at least six working sheath segments. This guarantees that each of the circularly curved working sheath segments is guided onto the support sheath from a radially outward direction and may be guided through the assigned fastening means through openings in the support sheath using the fastening means provided on the same.

In particular, to carry out compacting processes in street construction, for example, compacting asphalt material or the substrate lying under this type of asphalt material, it is advantageous if the working sheath segments provide a substantially closed, unstructured working exterior of the working sheath. For other operations, like compacting earth material of the like or for crushing solid substrates, it is advantageous if radially outwardly projecting roller tools are arranged on the working sheath segments to provide a structure working exterior of the working sheath.

The invention further relates to a soil processing machine comprising at least one soil working roller constructed according to the invention.

Figure 2:
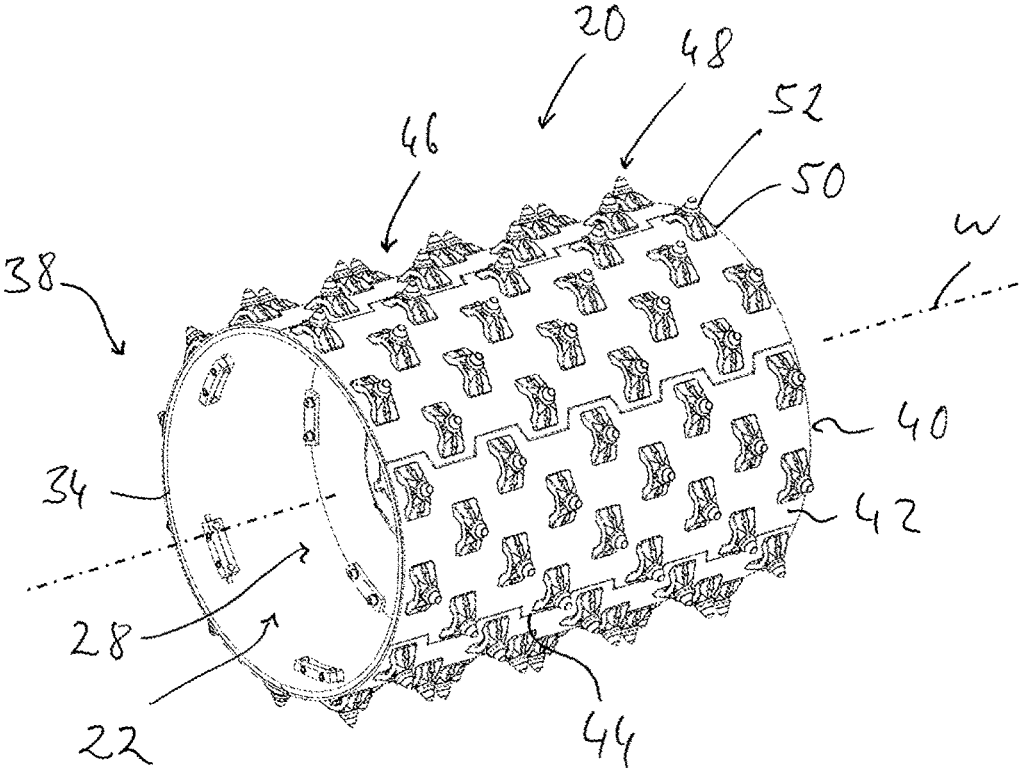
Figure 3:
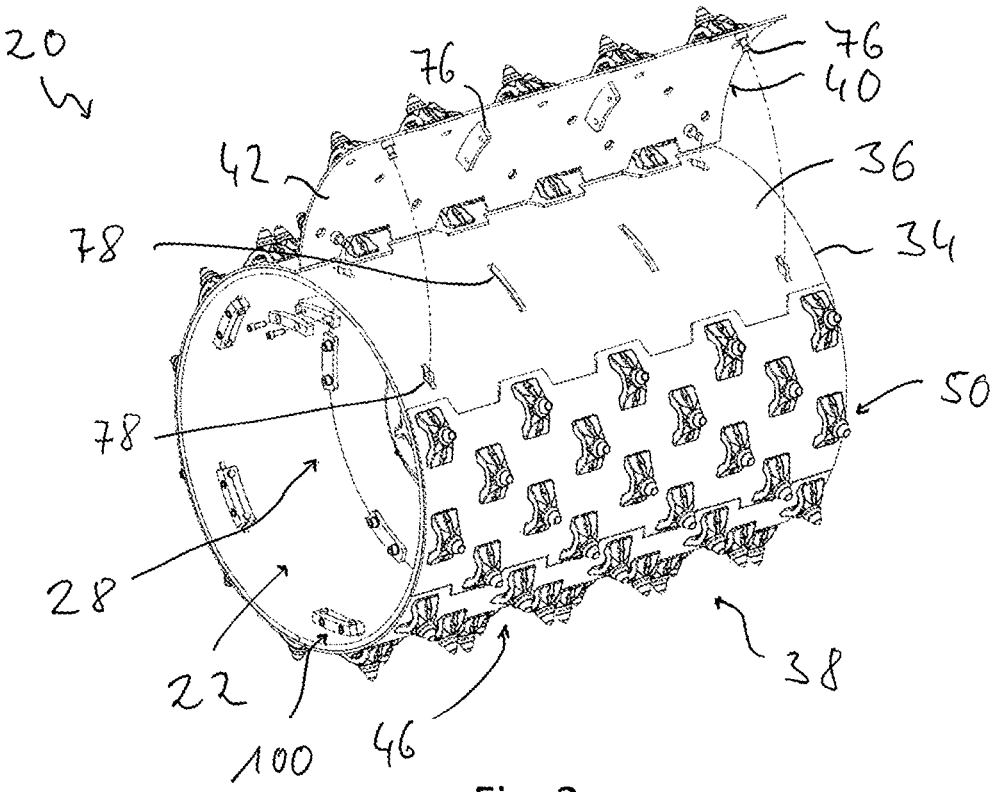
Figure 4:
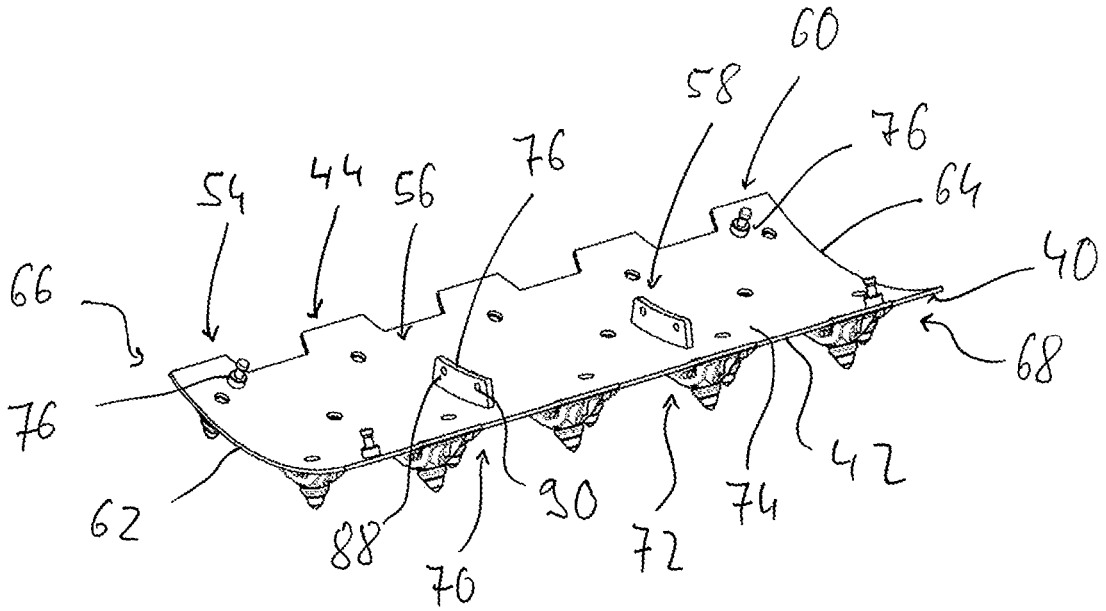
Figure 5:
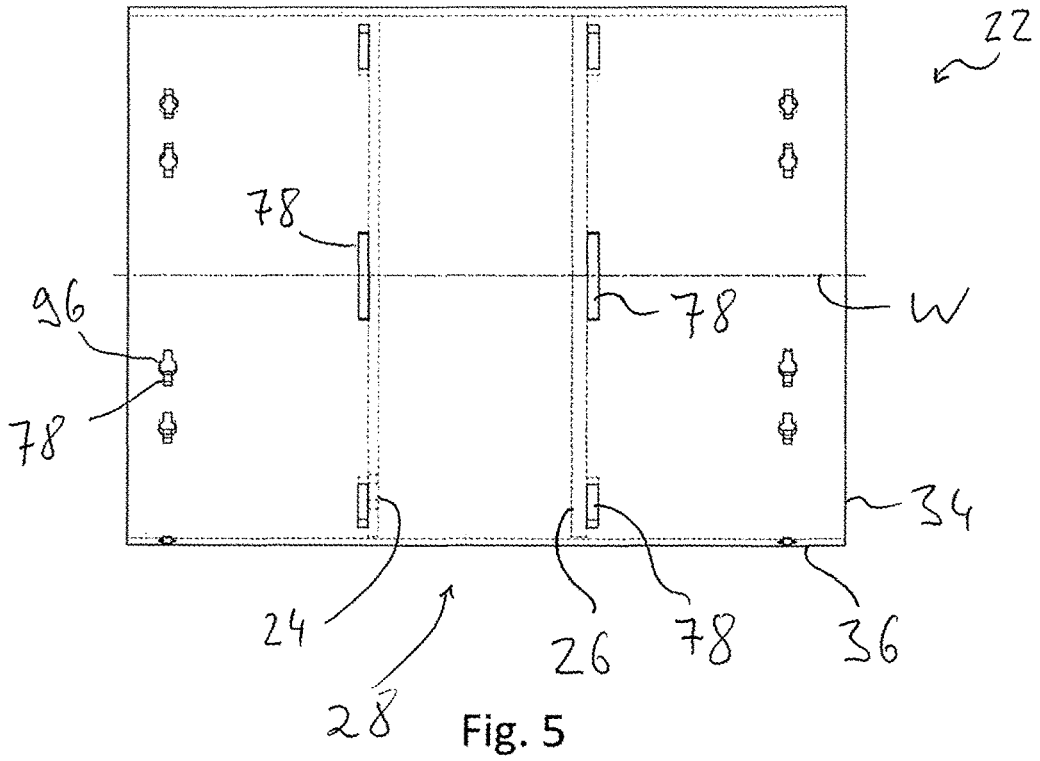
Figure 6:
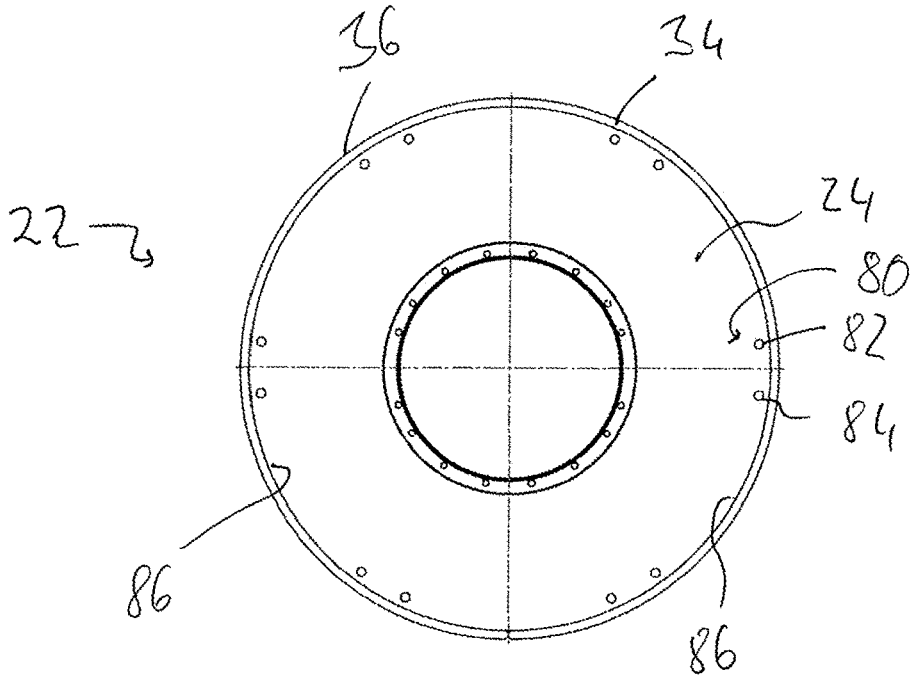
Figure 7:
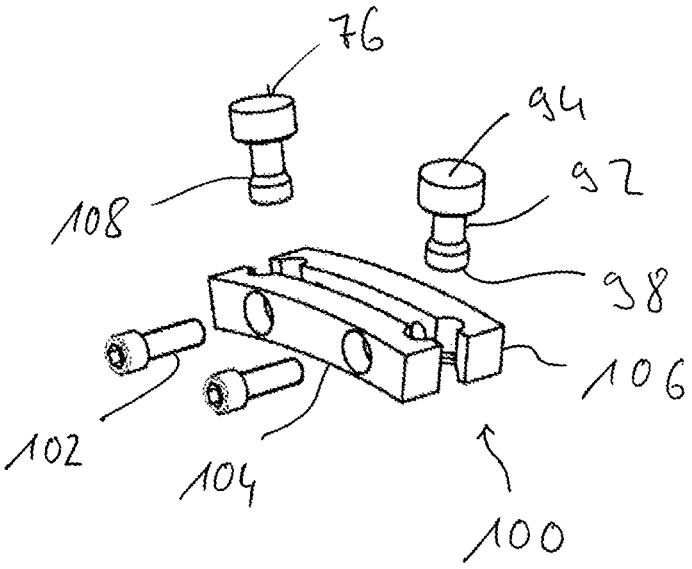
Figure 8:
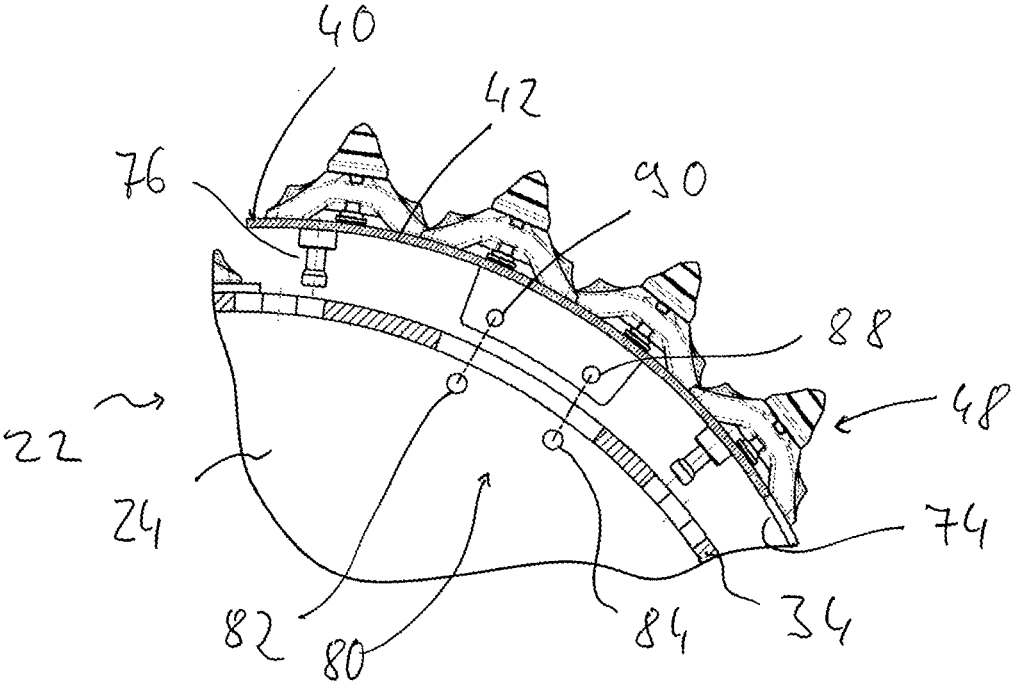
Figure 9:
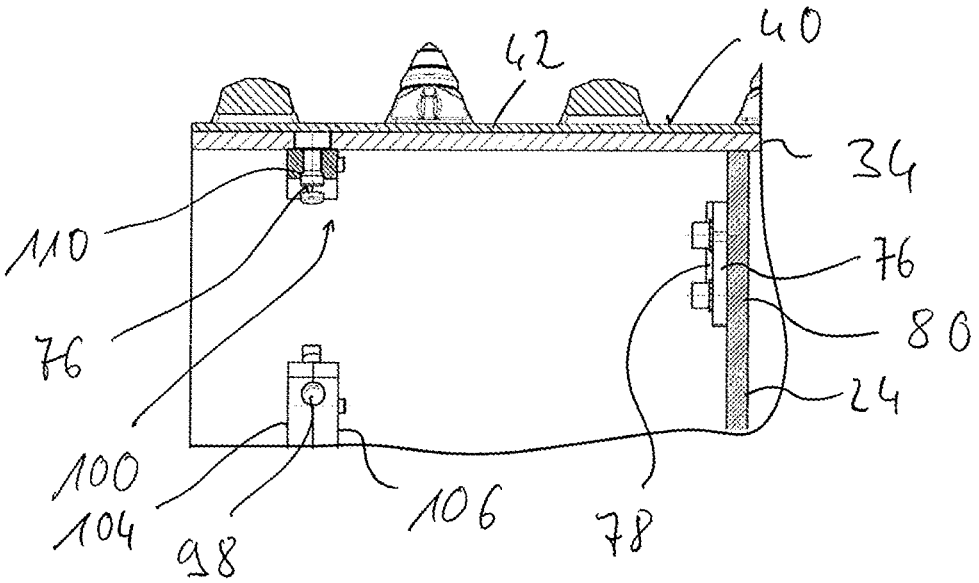
Figure 10:
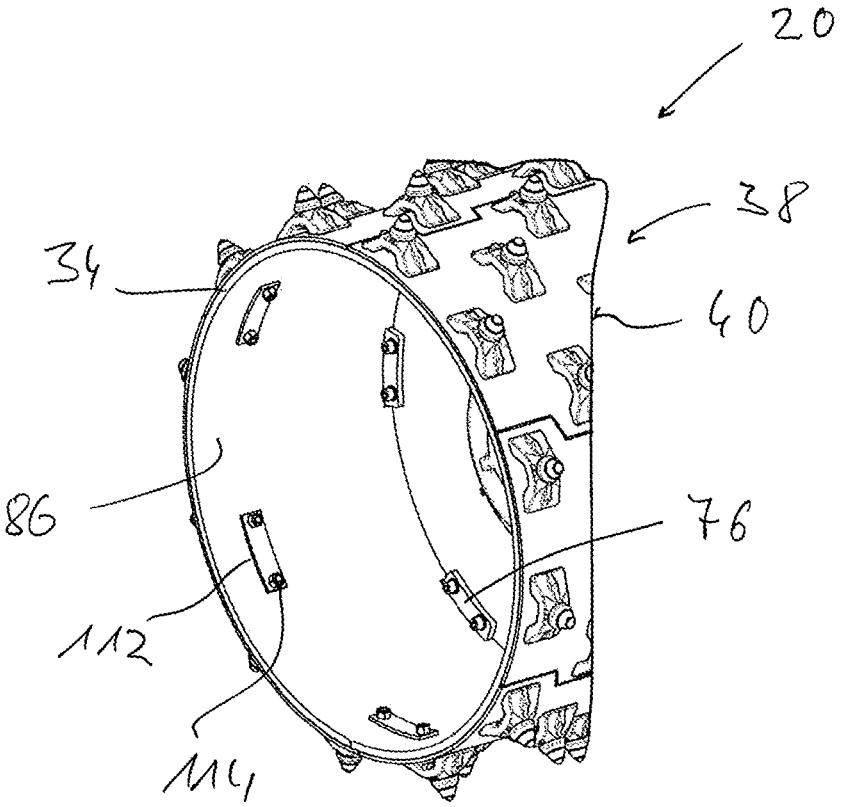
Figure 11:
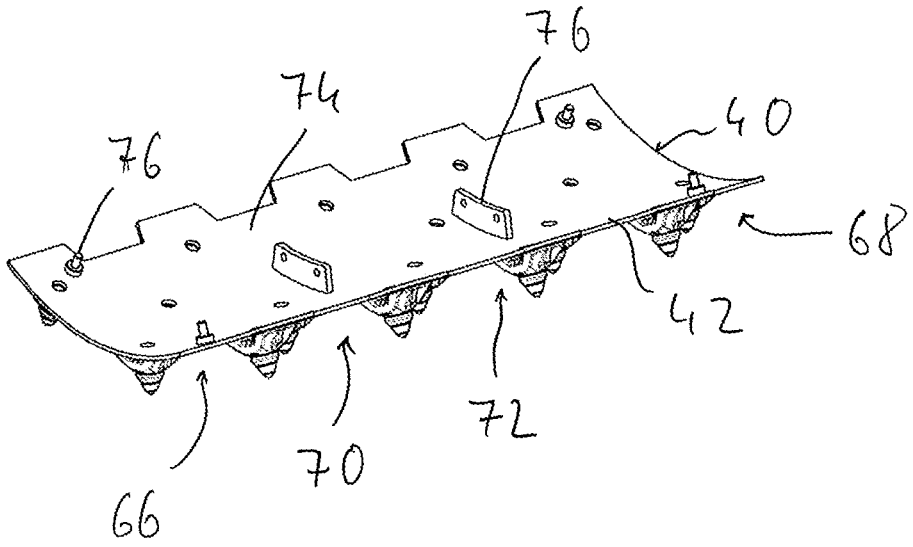
Figure 12:
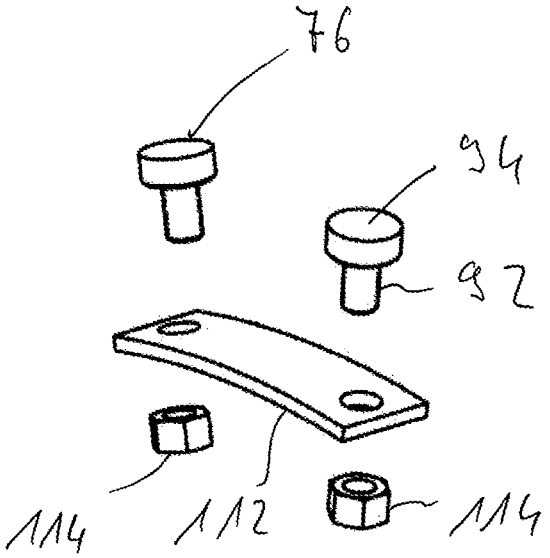
Figure 13:
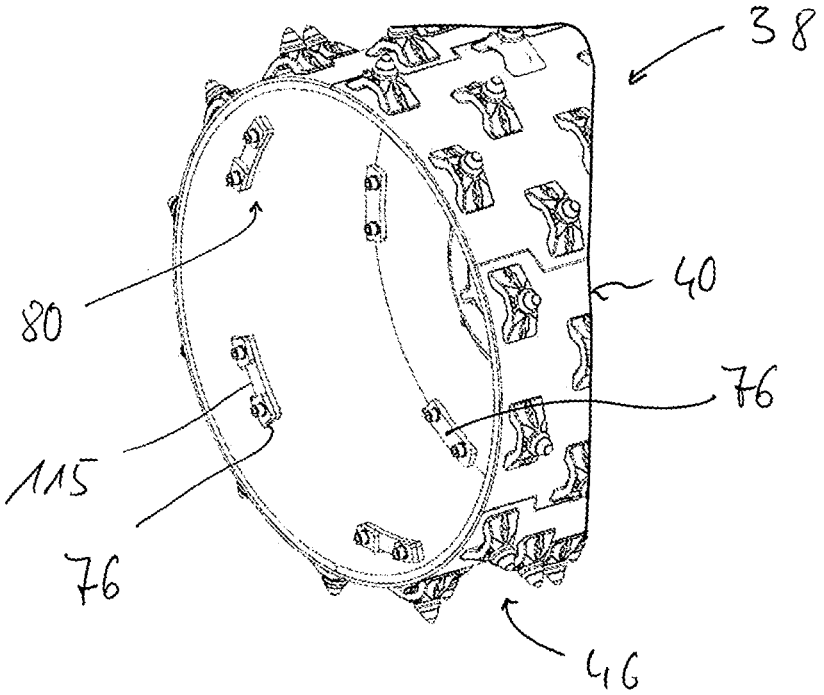
Figure 14:
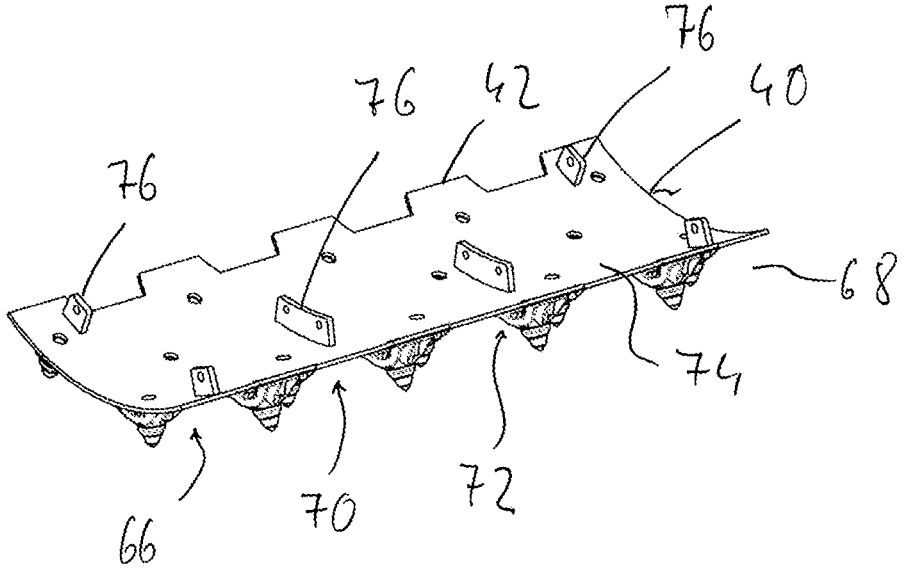
Figure 15:
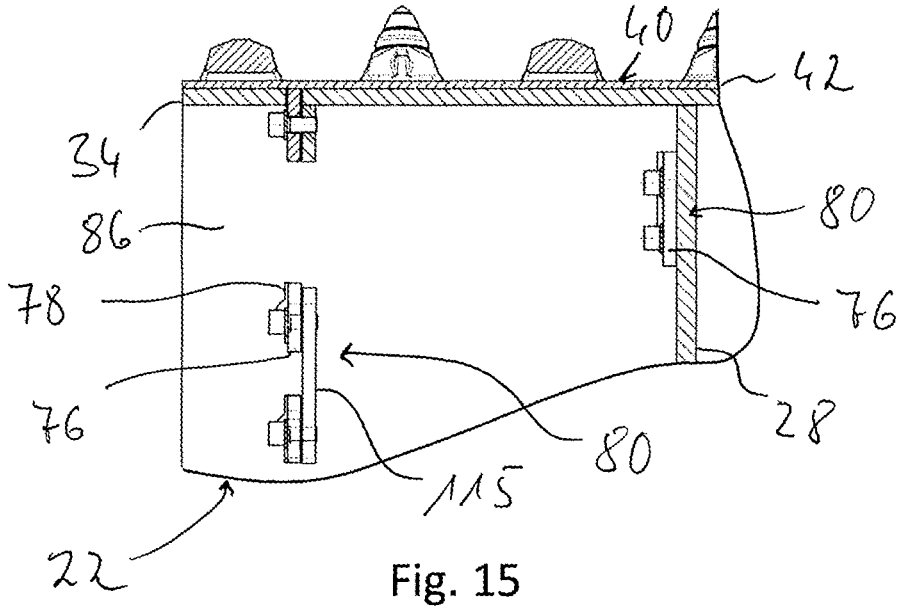
Figure 16:
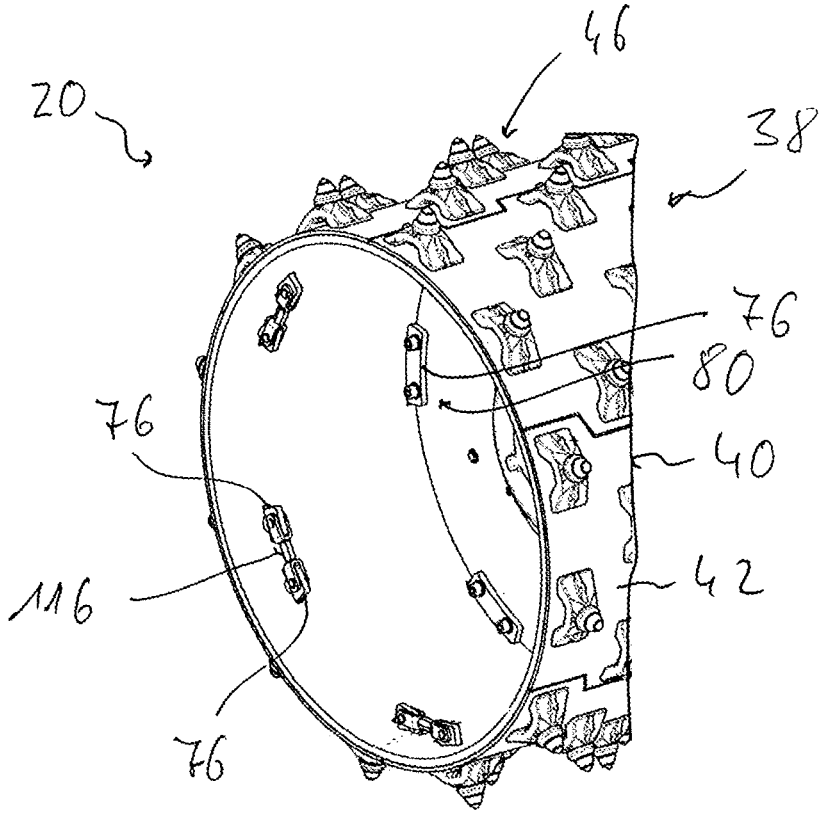
Figure 17:
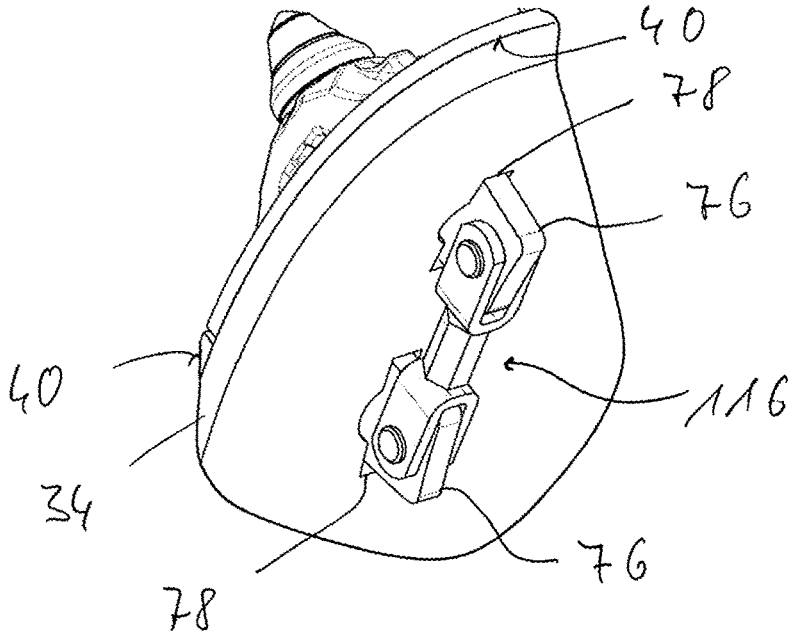
Figure 18:
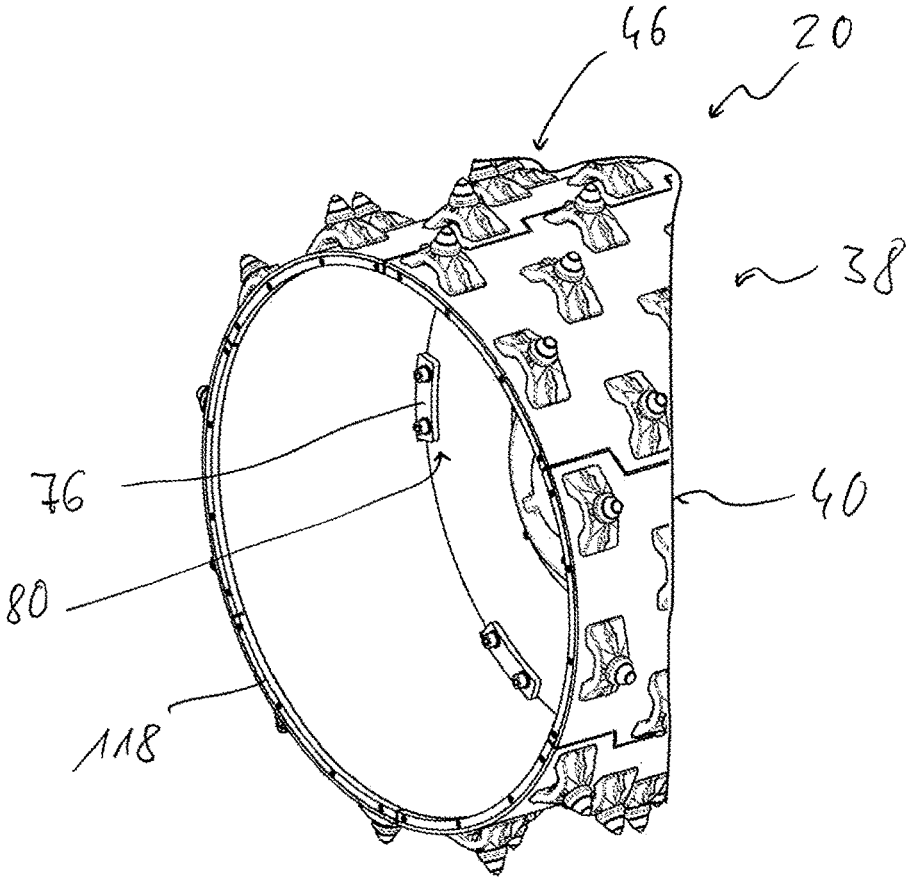
Figure 19:
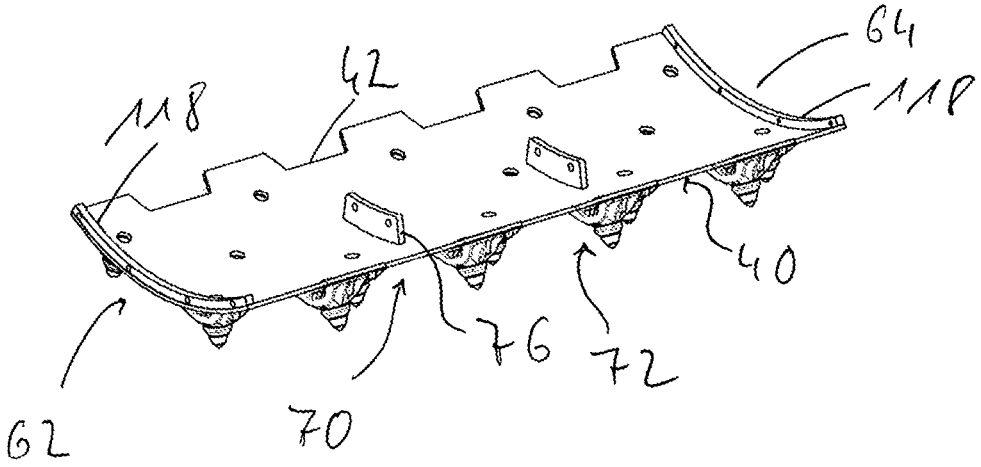
Figure 20:
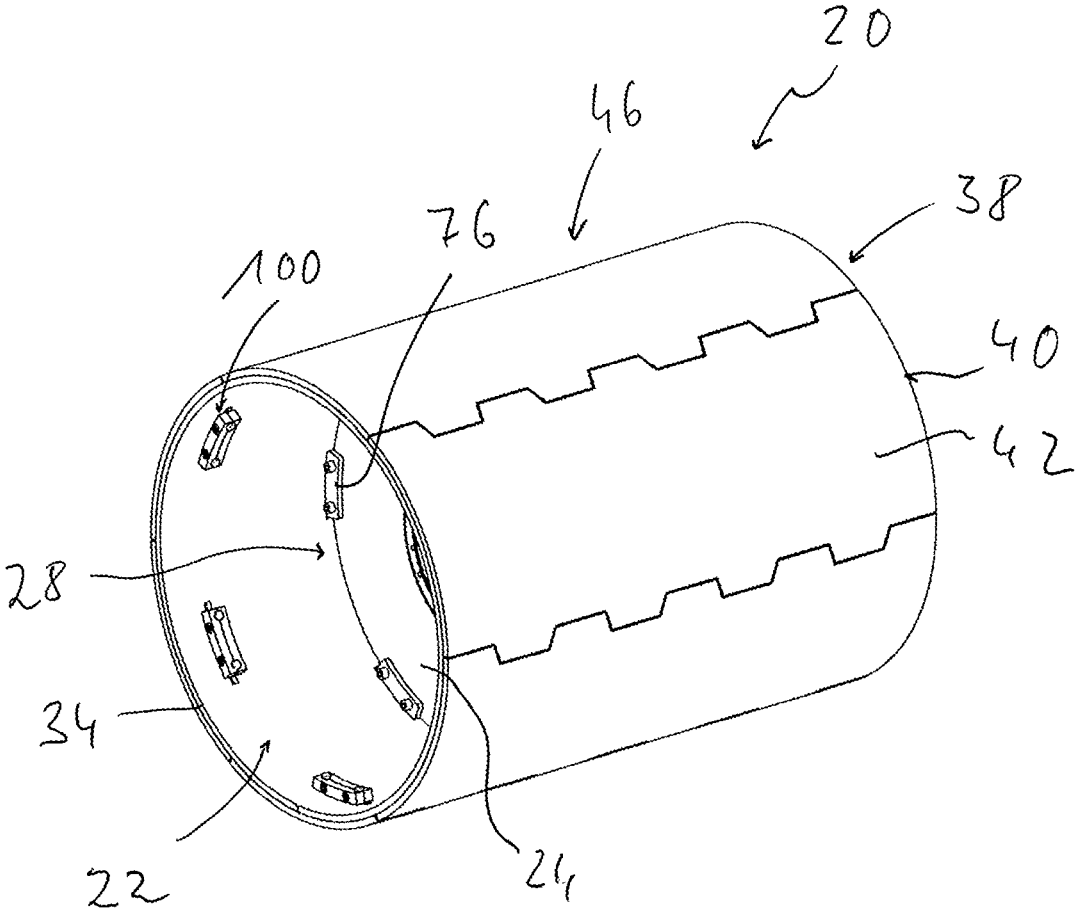
Figure 21:
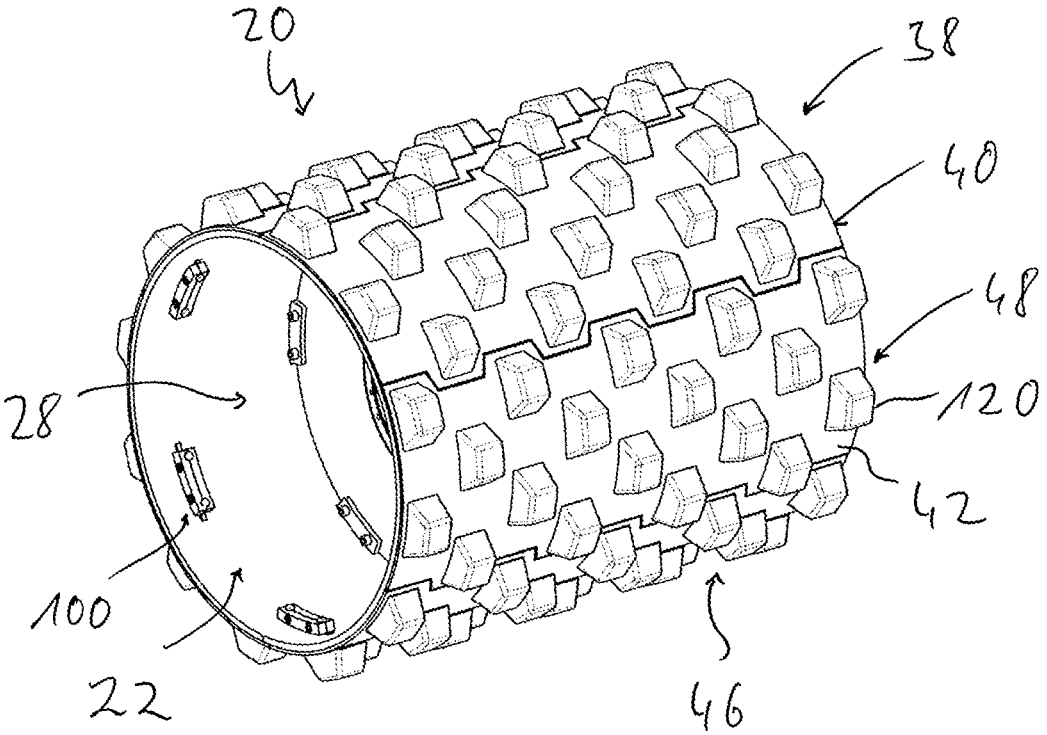

The invention is subsequently described in detail with reference to the appended figures. As shown in:

FIG. 1 a perspective view of a soil processing machine with a soil working roller;

FIG. 2 the soil working roller of the soil processing machine from FIG. 1 in a perspective view;

FIG. 3 the soil working roller from FIG. 2 with a working sheath segment, detached from a roller body of the soil working roller, of a working sheath provided on the roller body;

FIG. 4 a working sheath segment viewed on its inner side;

FIG. 5 the roller body of the soil working roller from FIGS. 2 and 3 in an outside radial view;

FIG. 6 an axial view of the roller body from FIG. 5;

FIG. 7 a jaw assembly, interacting with bolt-like fastening means, for fastening a working sheath segment to the roller body;

FIG. 8 a working sheath segment depicted radially detached from the roller body;

FIG. 9 an axial end area of a soil working roller with a working sheath segment fastened to the roller body by jaw assemblies from FIG. 7;

FIG. 10 a perspective view of the axial end area of a soil working roller with an alternative mounting method for working sheath segments;

FIG. 11 a working sheath segment of the soil working roller from FIG. 10, viewed on its inner side;

FIG. 12 bolt-like fastening means of working sheath segments as depicted in FIG. 11;

FIG. 13 a depiction, corresponding to FIG. 10, of another alternative embodiment for fastening working sheath segments to a roller body;

FIG. 14 a working sheath segment of the soil working roller from FIG. 13, viewed on its inner side;

FIG. 15 an axial end area of the soil working roller from FIG. 13;

FIG. 16 a depiction, corresponding to FIG. 10, with another alternative embodiment for fastening working sheath segments to a roller body;

FIG. 17 a detail view of the soil working roller from FIG. 16;

FIG. 18 a depiction, corresponding to FIG. 10, with another alternative embodiment for fastening working sheath segments to a roller body;

FIG. 19 a working sheath segment of the soil working roller from FIG. 18, viewed on its inner side;

FIG. 20 a depiction, corresponding to FIG. 2, of a soil working roller with another embodiment of a working sheath surrounding a roller body;

FIG. 21 another depiction, corresponding to FIG. 2, of a soil working roller with another embodiment of a working sheath surrounding a roller body.

In FIG. 1, a soil processing machine is generally designated with 10. Soil processing machine 10 comprises a rear section 12 with a drive assembly provided thereon and wheels 14 driven by the drive assembly, for example, a diesel internal combustion engine. Furthermore, a cabin 16 for an operator operating soil processing machine 10 is provided on rear segment 12.

A soil working roller, generally designated with 20, rotatable about a roller axis of rotation W, is supported on a front section 18 pivotably connected to rear section 12. Soil working roller 20, depicted in more detail in FIG. 2, is constructed with a roller body 22 rotatably mounted on front section 18. Roller body 22 comprises a support structure 28, constructed in the depicted embodiment using two support disks 24, 26 axially spaced apart from one another and generally designated as circular blanks, which are mounted via respective mounting areas on lateral frame areas 30, 32 of front segment 18 to be rotatable about roller axis of rotation W. Two support disks 24, 26 are fastened, for example by welding, in their outer peripheral area to a substantially cylindrical and annularly-closed support sheath 34.

A working sheath, generally designated with 38, is provided on the support sheath outer side 36. In the depicted embodiment, working sheath 38 comprises six working sheath segments 40, following one another in the circumferential direction and connecting directly to one another, which have curved segment shells 42 adapted to the circularly curved outer circumferential contour of support sheath 34. It is clear in FIG. 2 that segment shells 42 mutually engage in a tooth-like manner in their segment shell longitudinal edges 44 which adjoin one another in the circumferential direction. Alternatively, segment shell longitudinal edges 44 might also be formed extending in straight lines in the direction or roller axis of rotation W.

Compacting roller 20 in this depicted embodiment is constructed as a so-called ground breaking roller, and has for this purpose a plurality of roller tools 48 on a working exterior 46 of working sheath 38 on each of working sheath segments 40. In the depicted example, these roller tools are designed with an interchangeable holder 50 fastened, for example by welding, to a respective working sheath segment 40 and a replaceable tool 52, in the shape of a chisel, accommodated in the interchangeable holder.

Each working sheath segment 40, preferably designed identically to one another and constructed substantially mirror-symmetrically with respect to a longitudinal center, has four connecting regions 54, 56, 58, 60 axially spaced apart from one another in the direction of roller axis of rotation W. Working sheath segments 40 may be fastened in each of these four connecting regions 54, 56, 58, 60 to support sheath 34 of roller body 22 so that a stable connection to roller body 22 is guaranteed across the entire axial length of working sheath segments 40. Connecting regions 54, 60, located in axial end areas 62, 64 of working sheath segments 40, therefore each form an end connecting region 66 or 68, while connecting regions 56, 58, positioned closer to the longitudinal center area of working sheath segments 40, respectively form a center connecting region 70, 72.

One or more fastening means 76 is/are provided in each of connecting regions 54, 56, 58, 60 on a shell segment inner side 74 of segment shells 42 facing support sheath outer side 36. Fastening means 76, provided in center connecting regions 70, 72, are thereby designed as plate like and are fastened to segment shells 42, for example by welding, in such a way that they extend substantially in the circumferential direction and radially inward. In association with substantially circumferentially-extending, plate-like fastening means 76, arranged in center connecting regions 70, 72, slot-like fastening means through openings 78, elongated substantially in the circumferential direction, are provided in the support sheath. These are arranged axially directly adjacent to a respective support disk 24, 26 of support structure 28, as is clear in FIG. 5.

A fastening region 80, which is radially overlapped by a fastening means 76 fastened on the same, is formed on the roller body in association with each of these slot-like fastening means through openings 78 or in association with each fastening means 76 of center connecting regions 70, 72 to be positioned by engaging through this type of fastening means through opening 78. In the depicted embodiment, these fastening regions 80 are designed on the radially outer area of a respective support disk 24 or 26 and each comprises two openings 82, 84 provided, for example, with inner threads. When mounting a respective working sheath segment 40 on roller body 22, plate-like shaped fastening means 76 of center connecting regions 72, 74 are guided through fastening means through openings 78 provided axially immediately adjacent to support disks 24, 26, so that they project radially inward on a support sheath inner side 86. Bolts may be guided substantially axially through openings 88, 90 provided in fastening means 76 and screwed into openings 82, 84 of respectively assigned fastening region 80. Disk springs or securing rings or the like may thereby be positioned, for example, between the screw heads and respective fastening means 76, in order to impede or prevent a loosening of the bolts.

It is clear in FIG. 5, that fastening means through openings 78, provided directly adjacent to a respective support disk 24, 26, are positioned in each case with respect to support disks 24, 26 on the side facing axially away from one another, so that fastening means 76 of center connecting regions 70, 72, to be fastened using bolts on support disks 24, 26, may be easily fastened on support disks 24, 26 by means of bolts from axially outside.

Fastening means 76 provided in end connecting regions 66, 68 are configured as bolt-like and extend substantially radially inward to working sheath segment inner side 74. As is clear in FIG. 7, bolt-like fastening means 76 are constructed with a bolt foot 94, which is expanded with respect to a bolt shaft 92 and may be fastened to a respective segment shell 42 by welding, so that bolt-like fastening means 76 of end connecting regions 66, 68 are also arranged fixedly on segment shells 42. It should thereby be clear that no opening is formed in the area of one of fastening means 76 in segment shells 42 respectively supporting the same, for example, in order to be able to guide a respective fastening means through a segment shell 42. This has the result that, in particular in those areas in which fastening means 76 are arranged on segment shells 42, for example, on the outwardly exposed outer side of segment shells 42, no openings are formed that are subjected to wear or impair operating results. In the depicted embodiment, openings are formed in segment shells 42 only in the area of roller tools 48 in order to have access to replaceable tools 52 and to be able to detach the same from interchangeable holders 50. These openings are, however, covered on the outside by interchangeable holders 50 so that the risk of penetration of material through these openings or the risk of wear in the area of these openings does not exist.

In association with bolt-like fastening means 76 provided in end connecting regions 66, 68, bolt through openings 78, which are likewise slot-like and elongated substantially in the circumferential direction, are provided in support sheath 34. These fastening means through openings 78, arranged in the axial end areas of support sheath 34, have an expansion in a longitudinal area 96 located in their longitudinal center. Bolt feet 94 of bolt-like fastening means 76, positioned to engage in these fastening means through openings 78, may be accommodated in these expansions.

As is clear in FIG. 7, bolt-like fastening means 76 have a bolt head 98, expanded with respect to bolt shaft 92, on their end areas projecting radially inward. Bolt-like fastening means 76 project radially inwardly with their respective bolt shaft 92 and bolt head 98 on support sheath inner side 36, and are surrounded in these areas by a jaw assembly 100 respectively assigned to a pair of this type of bolt-like fastening means 76. Each jaw assembly 100 has two clamping jaws 104, 106 axially opposite one another and to be fixed to one another by bolts 102. Both bolt-like fastening means 76, surrounded by one of these types of jaw assemblies 100, are thereby respectively assigned to different working sheath segments 40 directly adjacent to one another. As is clear in FIG. 4, bolt-like fastening means 76, arranged in a respective end connecting region 66, 68 for this purpose, are arranged close to segment shell longitudinal edges 44 so that bolt-like fastening means 76, arranged on adjacent working sheath segments 40 and surrounded by a mutual jaw assembly 100, are closer to one another than both bolt-like fastening means 76 which are arranged in a respective end connecting region 66, 68 of working sheath segments 40.

In the case of clamping jaws 104, 106, respectively surrounding a pair of this type of bolt-like fastening means 76, these contact segment shell inner side 74 of assigned segment shells 42 and thereby generate a force effect acting radially inward on the surrounded, bolt-like fastening means 76, so that working sheath segments 40 are drawn firmly toward support sheath outer side 36. For this purpose, bolt-like fastening means 76 have conical wedge surfaces 108 on their respective bolt heads 98 which interact with respective wedge surfaces 110 on clamping jaws 104, 106 to generate this radially-inwardly directed force.

FIGS. 10 to 12 show an alternative embodiment of the fastening of working sheath segments 40 to roller body 22 in their end connecting regions 66, 68. In this embodiment, fastening means 76, arranged in end connecting regions 66, 68 are also designed as bolt-like and extend substantially radially inward or are fastened on segment shells 42. Bolt shaft 92, extending from respective bolt foot 94, is provided with external threads. A cover plate 112, contacting support sheath inner side 86, is first pushed onto bolt shafts 92, projecting radially inward past support sheath 34, of two bolt-like fastening means 76, directly adjacent in the circumferential direction. Nuts 114 are subsequently screwed onto bolt shafts 92 provided with external threads. Disk springs or securing rings or the like may also be provided between cover plate 112 and nuts 114, positioned on the inner side of the same, in order to impede or prevent a loosening of nuts 114.

Working sheath segments 40 are designed in center connecting regions 70, 72, as previously described in detail with respect to FIGS. 2 to 9, such that reference is made to these embodiments.

Another alternative embodiment for fastening working sheath segments 40 to a roller body 22 is depicted in FIGS. 13 to 15. Fastening means 76, provided in end connecting regions 66, 68, are designed as plate-like or tab-like in this embodiment and extend radially inwardly on segment shell inner side 74. Slot-like fastening means through openings 78 are designed in support sheath 34 in association with these plate-like fastening means 76 of end connecting regions 66, 68 and do not necessarily need to have the expanded longitudinal area, clearly visible in the previously described depiction, due to the plate-like configuration of fastening means 76.

Multiple plate-like fastening projections 115 of fastening areas 80 are provided, following one another in the circumferential direction and extending substantially in the circumferential direction and extending fixedly radially inwardly, fastened, for example by welding, on support sheath 34 on support sheath inner side 86. This type of plate-like fastening area 80 is provided, for example, in association with two plate-like fastening projections 115 of directly adjacent working sheath segments 40. Working sheath segments 40 may be fastened to roller body 22 in their two end connecting regions 66, 68 by bolts, screwed into internally-threaded openings of plate-like fastening areas 80 and axially engaging through plate-like fastening means 76, arranged radially overlapping the assigned plate-like fastening projections 115.

In this embodiment, working sheath segments 74 may also be fastened to roller body 22 in center connecting regions 70, 72 in the way previously described in detail with respect to FIGS. 2 to 9.

A modification is depicted in FIGS. 16 to 17 of the type of connection of working sheath segments 40 to roller body 22, depicted in FIGS. 13 to 15. In this embodiment, plate-like fastening means 76 of the end connecting regions, engaging through respective fastening means through openings 78, are not screwed to fastening areas provided on support sheath 34. Instead, fastening means 76, assigned to different and directly adjacent working sheath segments 40, are clamped in the circumferential direction to or on one another in their longitudinal areas projecting radially inwardly past support sheath 34 by a circumferential clamping means 116. As this is carried out for all working sheath segments 40 following one another in the circumferential direction, a closed circular structure is generated, due to which working sheath segments 40 are pretensioned in the circumferential direction with respect to one another on the one hand, and on the other hand are pretensioned radially inwardly and are thus pressed firmly against support sheath 34.

Another modification for fastening working sheath segments 40 to a roller body 22 is depicted in FIGS. 18 and 19. End connecting regions 66, 68 of working sheath segments 40 are thereby shaped so that they have edge sections 118 engaging across support sheath 40 radially inwardly on its axial end faces and acting as fastening means. Bolts may be screwed through these edge segments 118 into internally-threaded openings formed in the axial end faces of support sheath 34. The fastening in center connecting regions 70, 72 may again be carried out as previously described.

FIGS. 20 and 21 illustrate that a high level of variability exists in a soil working roller 20 designed according to the invention with a roller body 22 which merely assumes a support function and a working sheath 38 arranged on the outer periphery of roller body 22. While in the previously-described embodiments, working sheath 38 is provided with replaceable tools 52 designed as chisels, FIG. 20 shows the structure of a working sheath 38 with working sheath segments 40 providing a substantially unstructured, thus smooth working exterior 46. As no opening is formed in the segment shells 42 in the area of fastening means 76 functioning for fastening to roller body 22, the entire working exterior 46 is unstructured and may be used, for example, to compact asphalt material and to thereby generate a smooth surface.

In the case of the embodiment depicted in FIG. 21, roller tools 50 designed in the shape of padfoot tools 120 are provided on working sheath segments 40. These may be fastened to segment shells 42, for example by welding, alternatively however, they may also be interchangeably fastened by using interchangeable holders 50 on segment shells 42, clear in FIG. 2.

The previously described soil working roller, structured according to the invention in different embodiment variants, is characterized in that it has a basic structure divided into two system areas. The first of these system areas, namely the roller body, is rotatably supported on a machine frame of a soil processing machine and forms a support for the second of the system areas, namely the working sheath. In an operating mode of this type of soil working roller, the working sheath with its working exterior is in exclusive contact with the substrate to be processed. The roller body is always covered by the working sheath, so that the roller body itself, with the substantially unstructured, smooth outer side of its support sheath, is not subjected to any wear on the one hand and on the other hand may be optimally designed for connection to the working sheath. In particular, the support sheath may have openings for this in different length ranges and in different circumferential areas, through which openings fastening means may be guided for fastening the working sheath segments. As all of these openings are covered by the working sheath in the operating mode, there is no risk that contaminants may enter through these openings, nor is there a risk that these openings are reproduced in the substrate to be processed.

The invention claimed is:

1. Soil working roller for a soil processing machine comprising a roller body, rotatable about a roller axis of rotation, with a support structure for rotatable mounting of the roller body and with a support sheath supported radially outwardly on the support structure, further comprising a working sheath, which contacts a support sheath outer side and provides a working exterior of the soil working roller and comprises a plurality of working sheath segments, following one another in the circumferential direction, each working sheath segment having a segment shell, a plurality of radially inwardly projecting fastening means being fixedly arranged on a segment shell inner side of each segment shell facing the support sheath outer side of the support sheath and/or supported at the support sheath outer side, wherein in association with each fastening means a fastening means through opening is provided in the support sheath for receiving the associate fastening means such as to engage therethrough, and wherein each fastening means engaging through a fastening means through opening projects on a support sheath inner side of the support sheath for fixing to or with respect to the roller body.

2. Soil working roller according to claim 1, wherein no openings penetrating the segment shells are provided on the segment shells in the area of the fastening means.

3. Soil working roller according to claim 1, wherein fastening means, engaging through a fastening means through opening, of at least two working sheath segments which directly follow one another in the circumferential direction, are pretensioned to one another in the circumferential direction by a circumferential clamping means arranged radially inside of the support sheath.

4. Soil working roller according to claim 1, wherein the working sheath comprises at least four working sheath segments, and/or the working sheath segments provide a substantially closed, unstructured working exterior of the working sheath or that roller tools projecting radially outwardly are arranged on the working sheath segments to provide a structured working exterior of the working sheath.

5. Soil working roller according to claim 1, wherein at least one fastening means is fixedly arranged in each case on the segment shells in at least three connecting regions located spaced apart from one another in the direction of the roller axis of rotation.

6. Soil working roller according to claim 5, wherein a fastening means is fixedly arranged in at least one center connecting region located between the axial end areas of a respective segment shell.

7. Soil working roller according to claim 5, wherein at least two fastening means, arranged spaced circumferentially apart from one another, are fixedly arranged in end connecting regions located on axial end areas of a respective segment shell.

8. Soil working roller according to claim 7, wherein a circumferential spacing of the fastening means to one another in the end connecting regions is greater than a circumferential spacing of a respective fastening means to a segment shell longitudinal edge directly adjacent to the same.

9. Soil working roller according to one claim 1, wherein a fastening area is fixedly arranged on the support sheath inner side of the support sheath in association with at least one fastening means.

10. Soil working roller according to claim 9, wherein each fastening area is fixedly arranged on the support sheath axially following a fastening means through opening.

11. Soil working roller according to claim 9, wherein at least one fastening area comprises a fastening projection projecting radially inwardly on the support sheath inner side of the support sheath.

12. Soil working roller according claim 9, wherein a fastening means is fastenable on at least one fastening area by a screw connection.

13. Soil working roller according to claim 9, wherein at least one fastening area, provided in association with a fastening means arranged in a center connecting region, is provided on the support structure.

14. Soil working roller according to claim 13, wherein the support structure comprises at least one support disk connected to the support sheath inner side of the support sheath, and that at least one fastening area, provided in association with a fastening means fixedly arranged in a center connecting region, is provided in a radially outer area of a support disk.

15. Soil working roller according to claim 1, wherein at least one of the fastening means is designed as plate-like and is arranged extending in the circumferential direction.

16. Soil working roller according to claim 15, wherein a fastening means is fixedly arranged in at least one center connecting region located between the axial end areas of a respective segment shell, and wherein at least one substantially circumferentially-extending, plate-like fastening means is arranged in at least one center connecting region.

17. Soil working roller according to claim 15, wherein at least two fastening means, arranged spaced circumferentially apart from one another, are fixedly arranged in end connecting regions located on axial end areas of a respective segment shell, and wherein at least one substantially circumferentially-extending, plate-like fastening means is arranged in at least one end connecting region.

18. Soil working roller according to claim 1, wherein at least one of the fastening means is designed as bolt-like and is arranged extending substantially in the radial direction.

19. Soil working roller according to claim 18, wherein at least one substantially radially-extending, bolt-like fastening means is designed with external threads.

20. Soil working roller according to claim 18, wherein at least one substantially radially-extending, bolt-like fastening means has a bolt head located at a distance from the segment shell and interacts with a jaw assembly for fastening the segment shell to the support sheath.

21. Soil working roller according to claim 20, wherein the jaw assembly comprises two clamping jaws, fastened to one another, opposite one another, surrounding the bolt head of at least one substantially radially-extending, bolt-like fastening means.

22. Soil working roller according to claim 21, wherein the clamping jaws of a jaw assembly, surrounding at least one bolt head of a substantially radially-extending, bolt-like fastening means, are supported on the support sheath inner side of the support sheath and generate a force effect acting radially inwardly on the at least one bolt head surrounded by the same.

23. Soil working roller according to claim 21, wherein at least one jaw assembly interacts with the bolt heads of two substantially radially-extending, bolt-like fastening means, arranged on the segment shells of working sheath segments directly adjacent to one another in the circumferential direction.

24. Soil working roller according to claim 18, wherein at least two fastening means, arranged spaced circumferentially apart from one another, are fixedly arranged in end connecting regions located on axial end areas of a respective segment shell, and wherein at least one substantially radially-extending, bolt-like fastening means, is fixedly arranged in at least one end connecting region.

25. Soil working roller according to claim 1, wherein at least one fastening means through opening is slot-like and/or elongated substantially in the circumferential direction.

26. Soil working roller according to claim 25, wherein at least one of the fastening means is designed as bolt-like and is arranged extending substantially in the radial direction, and wherein at least one fastening means through opening, engaged through by a substantially radially-extending, bolt-like fastening means, is expanded in a longitudinal area transverse to its longitudinal extension to accommodate a bolt foot of the substantially radially-extending, bolt-like fastening means engaging through this fastening means through opening.

27. Soil processing machine comprising at least one soil working roller comprising a roller body, rotatable about a roller axis of rotation, with a support structure for rotatable mounting of the roller body and with a support sheath supported radially outwardly on the support structure, further comprising a working sheath, which contacts a support sheath outer side and provides a working exterior of the soil working roller and comprises a plurality of working sheath segments, following one another in the circumferential direction, each working sheath segment having a segment shell, a plurality of radially inwardly projecting fastening means being fixedly arranged on a segment shell inner side of each segment shell facing the support sheath outer side of the support sheath and/or supported at the support sheath outer side, wherein in association with each fastening means a fastening means through opening is provided in the support sheath for receiving the associate fastening means such as to engage therethrough, and wherein each fastening means engaging through a fastening means through opening projects on a support sheath inner side of the support sheath for fixing to or with respect to the roller body.

* * * * *